US005165583A

United States Patent [19]

Kouwenberg

[11] Patent Number: 5,165,583

[45] Date of Patent: Nov. 24, 1992

[54] INVERTABLE THERMALLY INSULATING CARRIERS

[76] Inventor: Robert J. C. Kouwenberg, Coole Abbey, Fermoy, County Cork, Ireland

[21] Appl. No.: 670,243

[22] Filed: Mar. 15, 1991

[30] Foreign Application Priority Data

Mar. 15, 1990 [GB] United Kingdom ..... 9005845

[51] Int. Cl.[5] ..... A45F 3/00

[52] U.S. Cl. ..... 224/148; 224/202; 220/4.24; 220/526; 220/902; 220/754; 206/428

[58] Field of Search ..... 224/202, 205, 148; 220/410, 903, 4.24, 526, 94 R, 902; 62/457.5, 457.7, 457.1, 457.4; 206/562, 428, 427

[56] References Cited

U.S. PATENT DOCUMENTS

| | | | |
|---|---|---|---|
| 1,927,706 | 9/1933 | House | 224/202 |
| 3,572,560 | 3/1971 | Dolph | 224/202 |
| 3,705,222 | 12/1972 | Rogers et al. | 220/4.24 |
| 3,734,336 | 5/1973 | Rankow et al. . | |
| 3,848,766 | 11/1974 | Gants et al. | 220/903 |
| 4,173,286 | 11/1979 | Stanko | 220/4.24 |
| 4,295,345 | 10/1981 | Atkinson | 206/427 |
| 4,323,180 | 4/1982 | Sloop | 224/205 |
| 4,339,062 | 7/1982 | Witt, Jr. | 224/148 |
| 4,541,540 | 9/1985 | Gretz et al. | 224/202 |

FOREIGN PATENT DOCUMENTS

| | | |
|---|---|---|
| 1156985 | 7/1969 | United Kingdom . |
| 2042159A | 9/1980 | United Kingdom . |

*Primary Examiner*—Linda J. Sholl
*Attorney, Agent, or Firm*—Price, Gess & Ubell

[57] ABSTRACT

A thermally insulating drinks carrier is formed in two halves, an upper body portion and a lower body portion. Each portion defines six cylindrical pockets arranged in two rows and six columns. A pin and recess on each body portion enables the two portions to be located and locked together. A carrying strap is threaded through bridging loops on each portion to imprison the two body portions together. The bridging loops span channels or guide slots in the sides of the body portions to act as guides for the strap. Each free end of the strap is wrapped around a wedge and wedged under a respective loop.

9 Claims, 6 Drawing Sheets

INVERTABLE THERMALLY INSULATING CARRIERS

BACKGROUND OF THE INVENTION

1. Field of the Invention

The present invention relates to invertable thermally insulating carriers.

Thermally insulating carriers are used to keep hot food hot and cold food cold. It is often difficult to keep hot and cold food in the same carrier at the same time. Most carriers such as used for picnics, lunches, and other events are required to carry bottles or cans of drink. When such a can or bottle of drink is taken from a cold environment, any moisture in the air in the carrier will be caused to condense onto the surface of the can and so create a wet environment within the carrier. Depending upon the other food within the carrier or the wrapping used, such food may thereby be spoiled.

2. Description of the Prior Art

U.S. Pat. No. 3 848 766 and British Pat. Nos. 2 042 159 and 1 156 985 describe a thermally insulated carrier divided into two parts. Each part is provided with mating pockets so as to house bottles, cans and other containers with little or no air space remaining. This helps to reduce condensation since condensation can only occur from the volume of air to which the container is exposed.

Each part can be used as a tray to stably hold the containers in a moving environment, for example on the seat of a car or a train, to avoid spillage of the contents of the containers. It is important therefore, that part-consumed containers can still be carried by the carrier in an upright manner so as to avoid spillage. In use with the carrier opened and all the containers in one half it may be desirable to replace empty or part consumed containers in the other half. To close the carrier when there are fewer full containers than part consumed or empty ones remaining, it is often more expedient to transfer the few remaining full containers to the other half. In this event the carrier when closed will need to be carried in an inverted mode. This is not possible with the arrangements described in the aforementioned patents.

SUMMARY OF THE INVENTION

It is an object of the invention to provide an invertable thermally insulating carrier.

According to the present invention there is provided an invertable thermally insulating carrier comprising a body portion separable into two parts, locating means for locating the two parts in a predetermined cooperating relationship, each part defining at least one cylindrical pocket, which pockets when the two parts are brought into the predetermined cooperating relationship cooperate to define an individual insulating enclosure for a cylindrical drinks can or bottle, each said part having parallel channels on opposite external sides thereof, each channel being bridged by a bridging member, and an elongate carrying strap having opposite end portions releaseably secured to the bridging members on one part of the body portion and an intermediate portion threaded through the bridging members of the other part of the body portion, to imprison the two parts of the body portions to each other.

BRIEF DESCRIPTION OF THE DRAWINGS

Invertable thermally insulating carriers embodying the present invention will now be described by way of example, with reference to the accompanying drawings in which.

DESCRIPTION OF THE PREFERRED EMBODIMENTS AND BEST MODE FOR CARRYING OUT THE INVENTION

Figure 1:
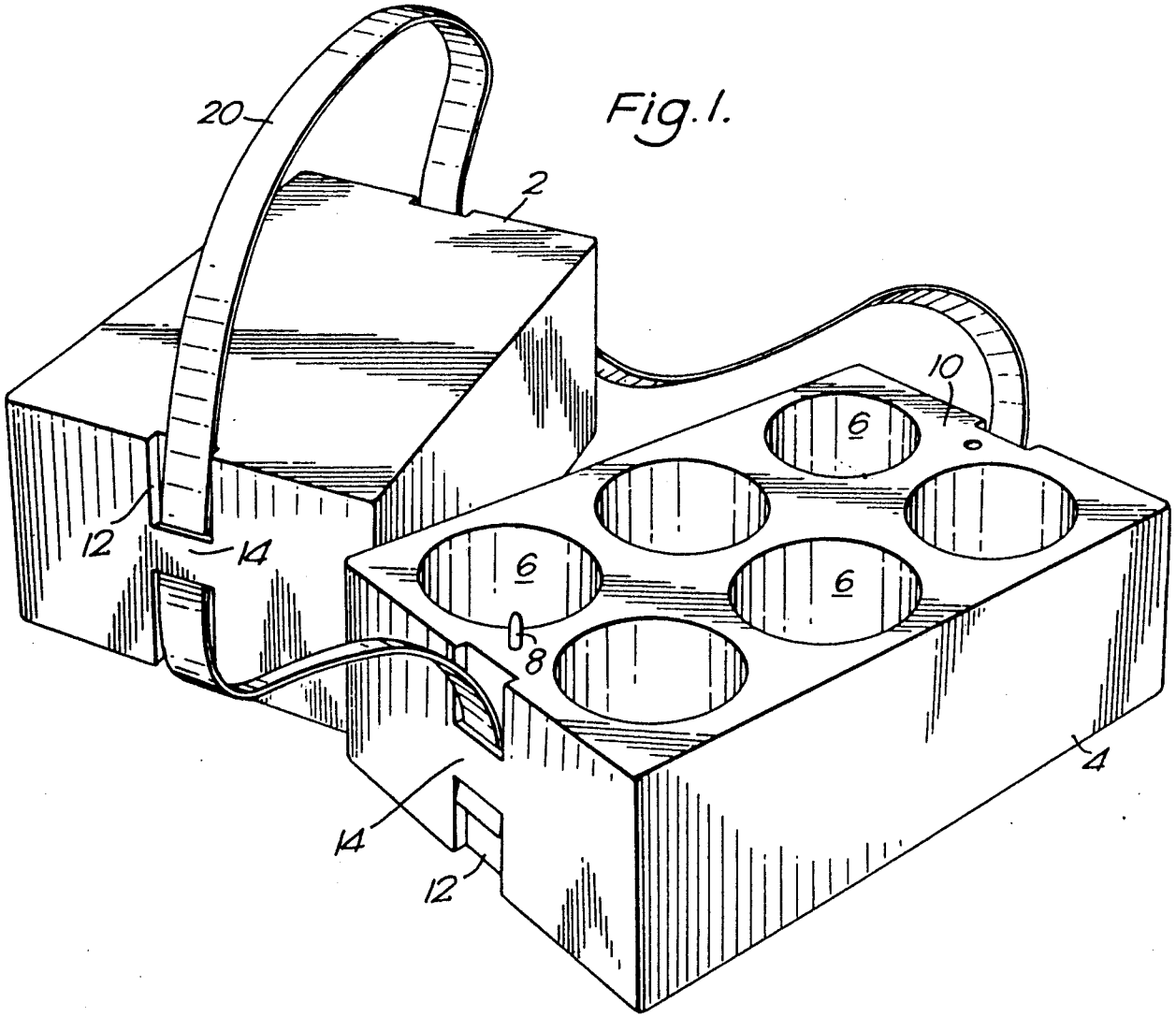
FIG. 1 is a perspective view of one carrier when opened.
Figure 2:
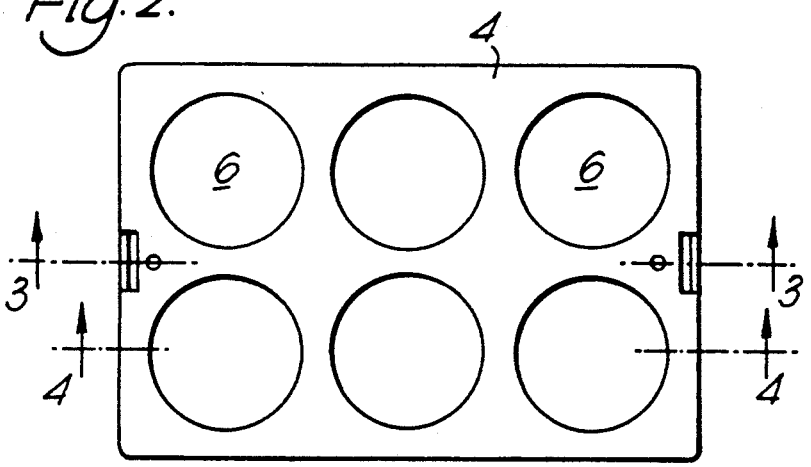
FIG. 2 is a plan view of the lower body portion of the carrier.
Figure 3:
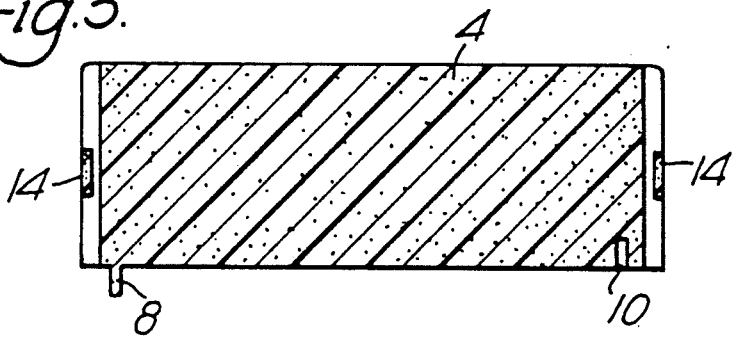
FIG. 3 is a section along the line 3—3 of FIG. 2.
Figure 4:
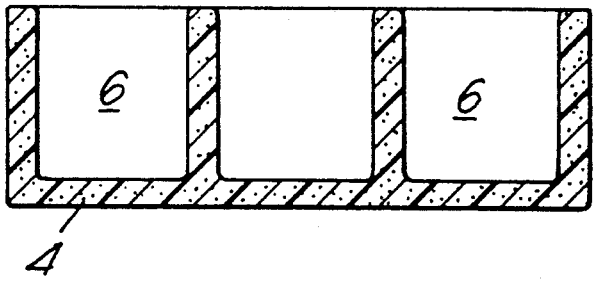
FIG. 4 is a section along the line 4—4 of FIG. 2.
Figure 5:
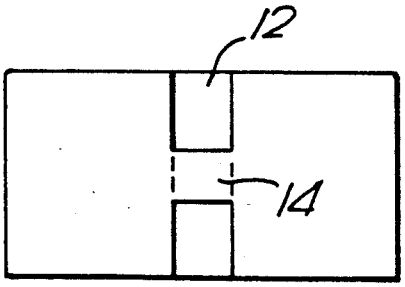
FIG. 5 is a side view of the portion of FIG. 4.

The thermally insulating carrier shown in FIG. 1 comprises an upper body half 2 and a lower body half 4 which are of similar configuration. Each body half is made of plastics material which exhibits good insulating characteristics for example, expanded polystyrene.

The lower body half has six cylindrical pockets 6 arranged in two rows and three columns. Each pocket 6 has a diameter substantially equal to the diameter of a standard drinks can, but has a depth just in excess of half the height of the standard size drinks can. The lower body half is symmetical about a common plane which intersects the body half midway between the two rows of pockets 6. In the upper surface of the lower body half, and intersected by the common plane are a projection 8, and a recess 10 sized to accommodate a projection of similar size to the projection 8. The projection 8 and recess 10 are spaced apart from one another and are arranged to matingly engage or be engaged by a recess and projection on the underside of the upper body half. Because the body halves 2 and 4 are similar and symmetrical about a common plane the projections 8 and recesses 10 can locate and lock the two body halves 2 and 4 together, so that each pocket 6 in one body half is aligned with a corresponding pocket 6 in the other half.

Figure 7:
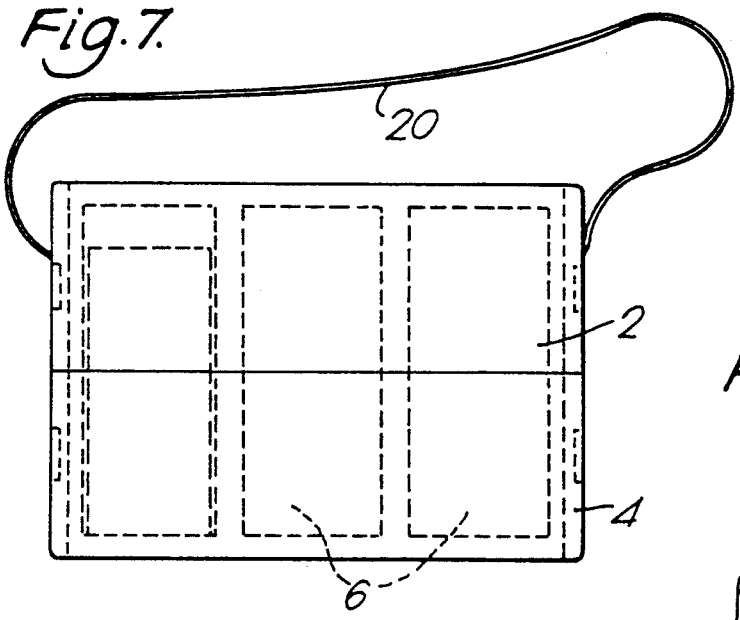
FIGS. 7, 8 and 9 are respectively a front elevation, a plan view and side elevation of the carrier when closed.
Figure 6:
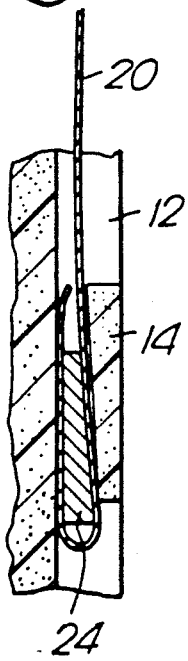
FIG. 6 is a cross-section to an enlarged scale showing a detail of the lower body portion of FIG. 2.
Figure 8:
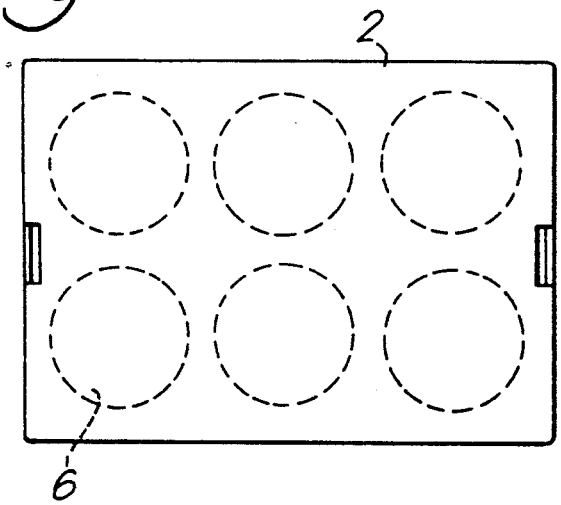
Figure 9:
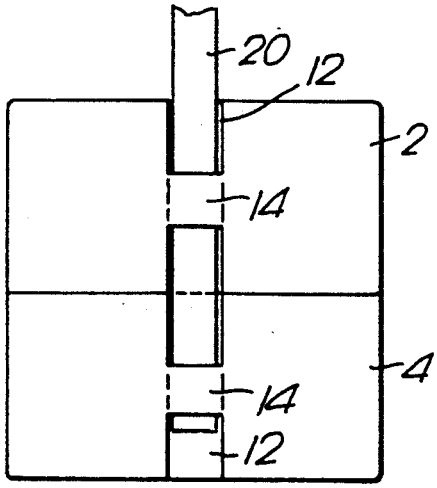

Opposing sides of the two body halves 2 and 4 are provided with a central, vertically extending, slot 12. Each slot 12 is bridged by a central transversely extending bridging strip 14. A common strap 20 of webbing-like material is threaded along each slot 12 to pass under each bridging strip 14 and so link the upper body half 2 to the lower body 4. Each free end of the strap 20 is folded around a respective wedge 24 (see FIG. 6) and jammed or wedged under a corresponding bridging strip 14 in the lower body half 4. This thus locks each free end of the strap in the respective channel 14 in the lower body half. The upper body half 2 is held capative to the lower body half 4 because the web 20 passes under the bridging strip 14 in respective channels of the upper body half. The strap 20 being of considerable length allows upper body half to have a fair amount of freedom of movement so that the upper body half can be moved from a position in which it is locked on top of the lower body half 4 (see FIGS. 7 and 9) to a position in which it lies to one side of the lower body half on the same surface on which the lower body half is resting.

The strap 20 acts not only to guide the upper body half into locking engagement with the lower body half but also as a carrying strap.

In operation each pair of cooperating pockets in the two body halves accommodates a respective drinks can. Because little or no space is left between the can and the pocket wall very little air can come into contact with the can and so condensation is kept to a minimum. Each can is completely surrounded by its own insulation and so its temperature will be held steady for longer. Where the carrier is required to hold some cans at room temperature and the other can at a colder or hotter temperature this can be done without a significant transfer of heat between the cans.

When the upper body half is lifted off the lower body half, the lower body half acts as a stable tray for the cans. This is particularly useful in a moving environment such as on the seat of a car or in an outdoor situation where the level of the ground is uneven—e.g. on a beach. When one can is being consumed the weight of the remaining cans will act as ballast to keep the tray steady and this will reduce the chance of the open can from falling over once it is returned to the tray.

The easy manner in which the strap 20 can be released and recoupled enables the carrier to be readily converted for carrying in an inverted mode.

Where the carrier is required to carry contents other than cans each body half may be provided with a mixture of cylidrical and rectangular pockets.

Figure 10:
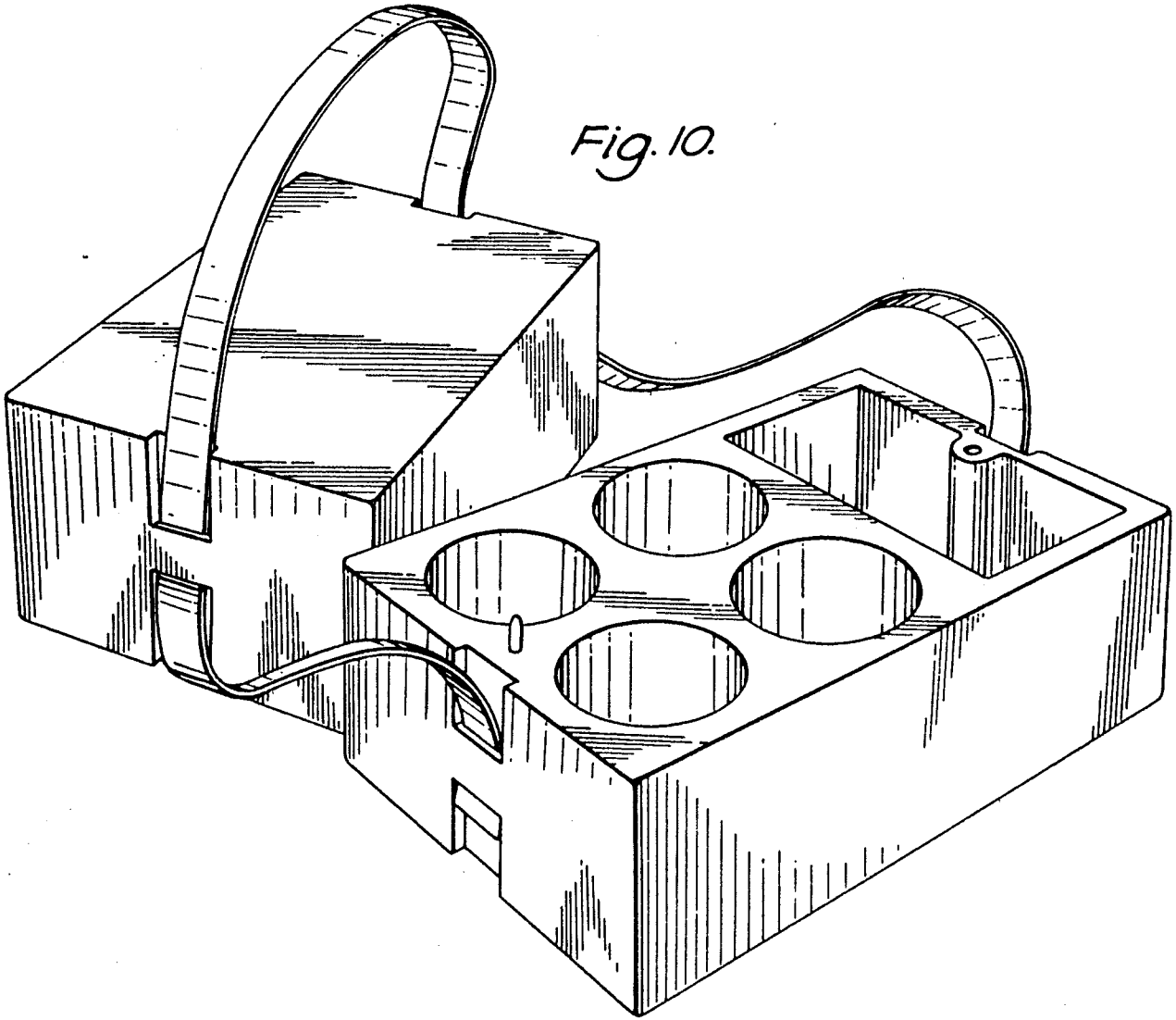
FIG. 10 is a perspective view of another carrier.

In the carrier shown in FIG. 10 the two cylindrical pockets in the last column are replaced with a short rectangular pocket 30.

Figure 11:
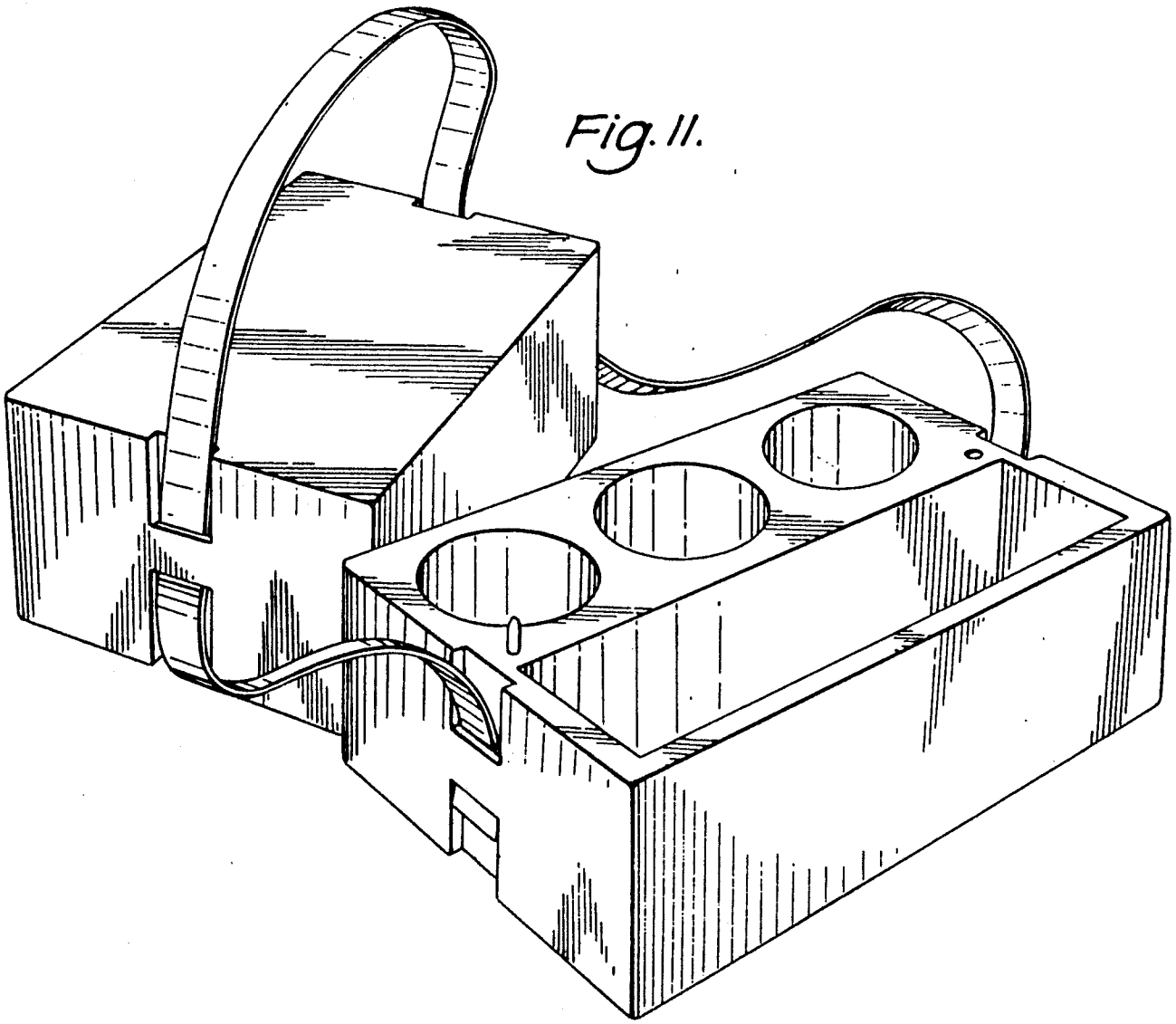
FIG. 11 is a perspective view of yet another carrier.

In the carrier shown in FIG. 11 the three cylindrical pockets in the second row are replaced with an elongate rectangular pocket 32.

It will be appreciated that other adaptations are also possible.

In the embodiment of FIG. 1 the carrier can be made as a disposable or throw-away carrier, for example in special promotion form for selling beer and other beverages in six packs for example.

Figure 12:
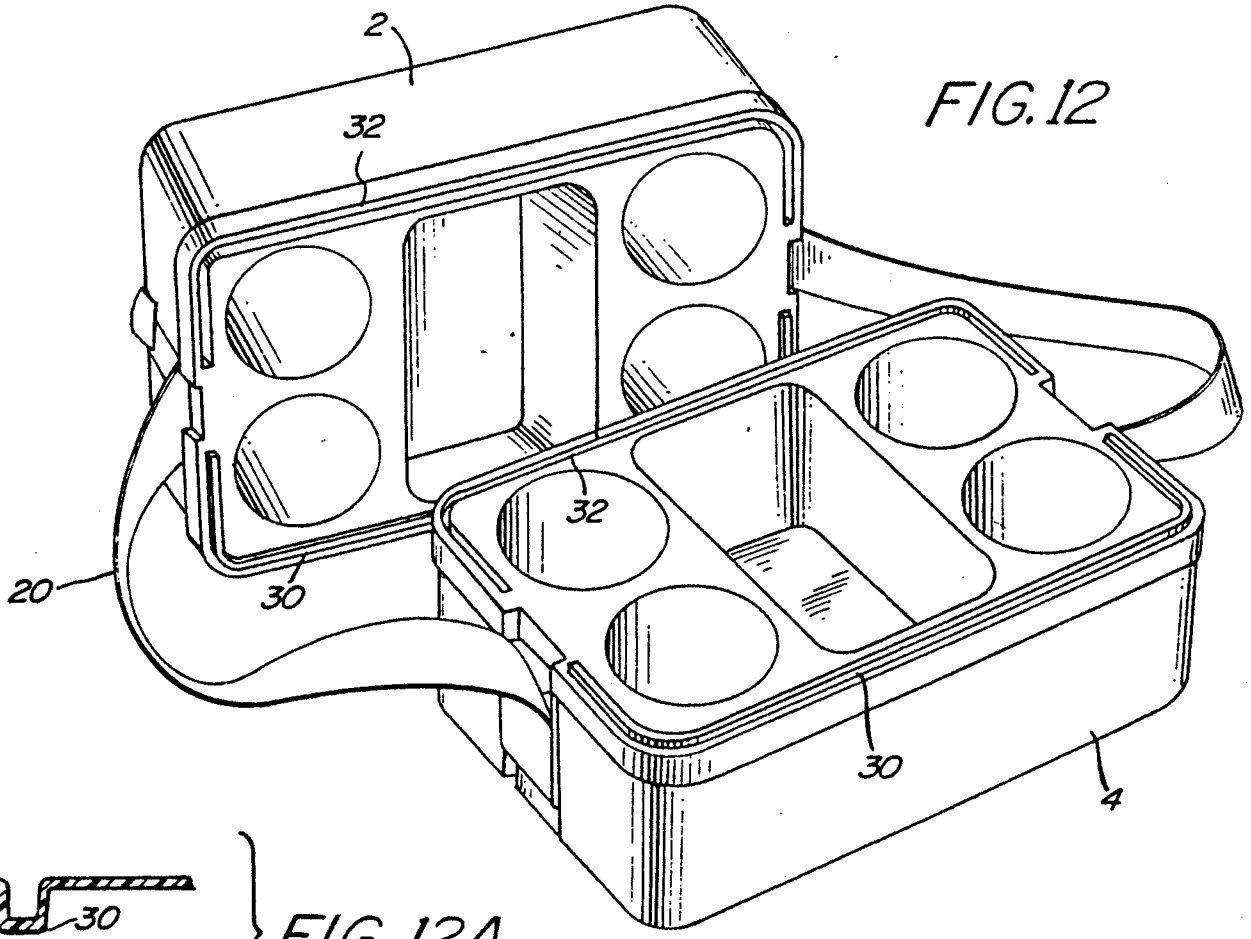
FIG. 12 is a perspective view of yet a further carrier.

In the embodiment shown in FIG. 12 the arrangement is similar to that of FIG. 10 except that instead of the short rectangular pocket replacing the cylindrical pockets of the last column it replaces the cylindrical pockets of the middle column.

Also the locating means is different. As can be seen the mating surface of each half is provided with a peripherally extending rib 30 around one half portion of its mating face and peripherally extending channel 32 around the other half portion of its face.

Figure 12A:
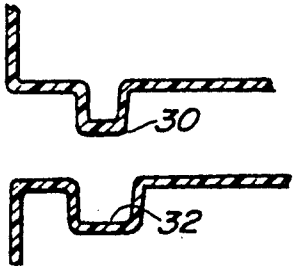
FIG. 12A is a scrap view of the locating rib and channel of the carrier of FIG. 12.

The channel 32 and the rib 30 are of complementary cross-section (see FIG. 12A). Both halves 2 and 4 are identical so that when the mating faces of the two halves 2 and 4 are brought into engagement, the rib 32 on one half engages the channel 30 on the other half and vice versa.

As can be seen from all the embodiments the two halves are identical in each case which makes for easy manufacture—the same tool can be used to manufacture both halves, and easy replacement—only one replacement part is needed not two.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. An invertable thermally insulating carrier for containing at least one cylindrical can or bottle, said carrier comprising:

a body portion having two identical separable parts;

identical locating means on each part for locating the two parts in a predetermined cooperating relationship, each part defining at least one cylindrical pocket, which pockets, when the two parts are brought into the predetermined cooperating relationship, cooperate to define an individual insulating enclosure for a cylindrical can or bottle;

each said part defining identical parallel channels on opposite external sides thereof;

a bridging member integrally formed on each opposing external side of each part to bridge each channel member, each bridging member of each opposing external side being identical; and an elongate carrying strap having opposite end portions and an intermediate portion, the opposite end portions being releasably secured to the opposing bridging members on one part of the body portion and the intermediate portion being threaded through the opposing bridging members of the other part of the body portion, to connect the two parts of the body portions to each other, the two parts of the body portion being identical to allow the two parts to be molded from a single mold, and to allow the two parts to be employed interchangeably with the strap.

2. A carrier according to claim 1, wherein said locating means comprises a projection on one part which cooperates with a recess on the other part.

3. A carrier according to claim 1, including a wedge for each end portion of the carrying strap to trap the end portion when wrapped around the wedge below a respective bridging member of said one part of the body portion.

4. A carrier according to claim 1, wherein each part defines six pockets which when the two parts are in said predetermined cooperating relationship define six separate enclosures arranged in two rows and three columns.

5. A carrier according to claim 1, wherein each part defines five pockets, four pockets being of circular cross-section and being arranged in an array of two rows and two columns and one pocket being of rectangular cross-section and being aligned in a further column.

6. A carried according to claim 5, wherein the column containing the pocket of rectangular cross-section lies intermediate the columns containing the other pockets.

7. A carrier according to claim 1, wherein each part defines three pockets of circular cross-section and one pocket of rectangular cross-section, the three pockets of circular cross-section being aligned along an axis extending parallel to the longitudinal axis of the pocket of rectangular section.

8. A carrier according to claim 1, wherein the locating means comprises a peripherally extending channel and peripherally extending rib of complementary cross-section defined by one said part arranged to mate with a peripherally extending rib and a peripherally extending channel of complementary cross-section defined by the other part.

9. A carrier according to claim 1, wherein each said part defines a further pocket of rectangular cross-section which when the two parts are in said predetermined cooperating relationship define an auxiliary rectangular enclosure.

* * * * *